United States Patent [19]

Baumann

[11] 3,946,640

[45] Mar. 30, 1976

[54] MOBILE ANTI-AIRCRAFT DEVICE

[75] Inventor: Emil Baumann, Niederglatt, Switzerland

[73] Assignee: Contraves AG, Zurich, Switzerland

[22] Filed: Nov. 23, 1973

[21] Appl. No.: 418,615

[30] Foreign Application Priority Data

Dec. 4, 1972 Switzerland ..... 17613/72

[52] U.S. Cl. ..... 89/1.815; 89/40 C; 89/41 H

[51] Int. Cl.[2] ..... F41F 3/04

[58] Field of Search ..... 89/1.815, 36 H, 40 B, 40 C, 89/405, 41 AA, 41 H

[56] References Cited

UNITED STATES PATENTS

| | | | |
|---|---|---|---|
| 1,366,550 | 1/1921 | Alden | 89/36 H |
| 2,981,150 | 4/1961 | Miller | 89/1.815 |
| 3,602,088 | 8/1971 | Spring | 89/41 AA |

FOREIGN PATENTS OR APPLICATIONS

| | | | |
|---|---|---|---|
| 941,469 | 4/1956 | Germany | 89/1.815 |
| 336,724 | 4/1959 | Switzerland | 89/405 |

*Primary Examiner*—Stephen C. Bentley
*Attorney, Agent, or Firm*—Werner W. Kleeman

[57] ABSTRACT

A mobile anti-aircraft weapon incorporating a housing rotatable about a substantially vertical axis with respect to the chassis of a support vehicle. The housing is equipped with side doors which can be pivoted about hinges and a respective rocket launcher accommodating a plurality of rockets mounted at the outside of each side door and serving as weapons.

5 Claims, 13 Drawing Figures

MOBILE ANTI-AIRCRAFT DEVICE

BACKGROUND OF THE INVENTION

The present invention relates to an improved construction of mobile anti-aircraft device or weapon.

In Swiss Pat. No. 490,655, there is disclosed a mobile anti-aircraft device incorporating a motor driven housing which is rotatable about a vertical axis with respect to the chassis of a support vehicle, and in which housing there are provided seats for operating personnel as well as operating-, computer- and control devices and there further being provided observation- and target tracking devices as well as weapons.

With prior art weaponry, there are mounted in the housing wall anti-aircraft cannons serving as the weapons and the internal compartment of the housing which is constructed as a rotatable armored turret is only accessible by a cover manhole.

SUMMARY OF THE INVENTION

It is a primary object of the present invention to provide, in place of anti-aircraft cannons, rocket or missile launchers and to install such at the housing in a manner that the inner compartment thereof is more comfortably accessible from both sides than with the heretofore known weapons of this type.

Now in order to implement this object and others which will become more readily apparent as the description proceeds, the invention contemplates providing the rotatable housing with flat or planar side doors which can be pivoted outwardly about vertical axis hinges, and that rocket launchers each accommodating a plurality of rockets and serving as the weapons are mounted at the outside of such doors at a respective horizontal and motor pivotable bearing axis or shaft.

It is preferably additionally contemplated that for rocking or pivoting each rocket launcher about its horizontal support or bearing axis, there are utilized hydraulically actuated pistons, the cylinders of which are pivotably supported at the relevant or corresponding side door. Furthermore, there is advantageously contemplated, just as is the case with other weaponry of known construction, the provision of hydraulically actuatable supports which are adjustably arranged at the vehicle chassis to move from a travelling position into a work position.

In order to avoid torsional forces, which cannot be measured by instruments and which cannot be avoided, of the vehicle chassis supported at uneven terrain being transmitted to the vertical rotational axis of the housing, it is of advantage if its vertical axis-pivot bearing or support is arranged in a torsionally resistant-intermediate chassis which in turn is supported through the agency of three pivot supports at the vehicle chassis.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
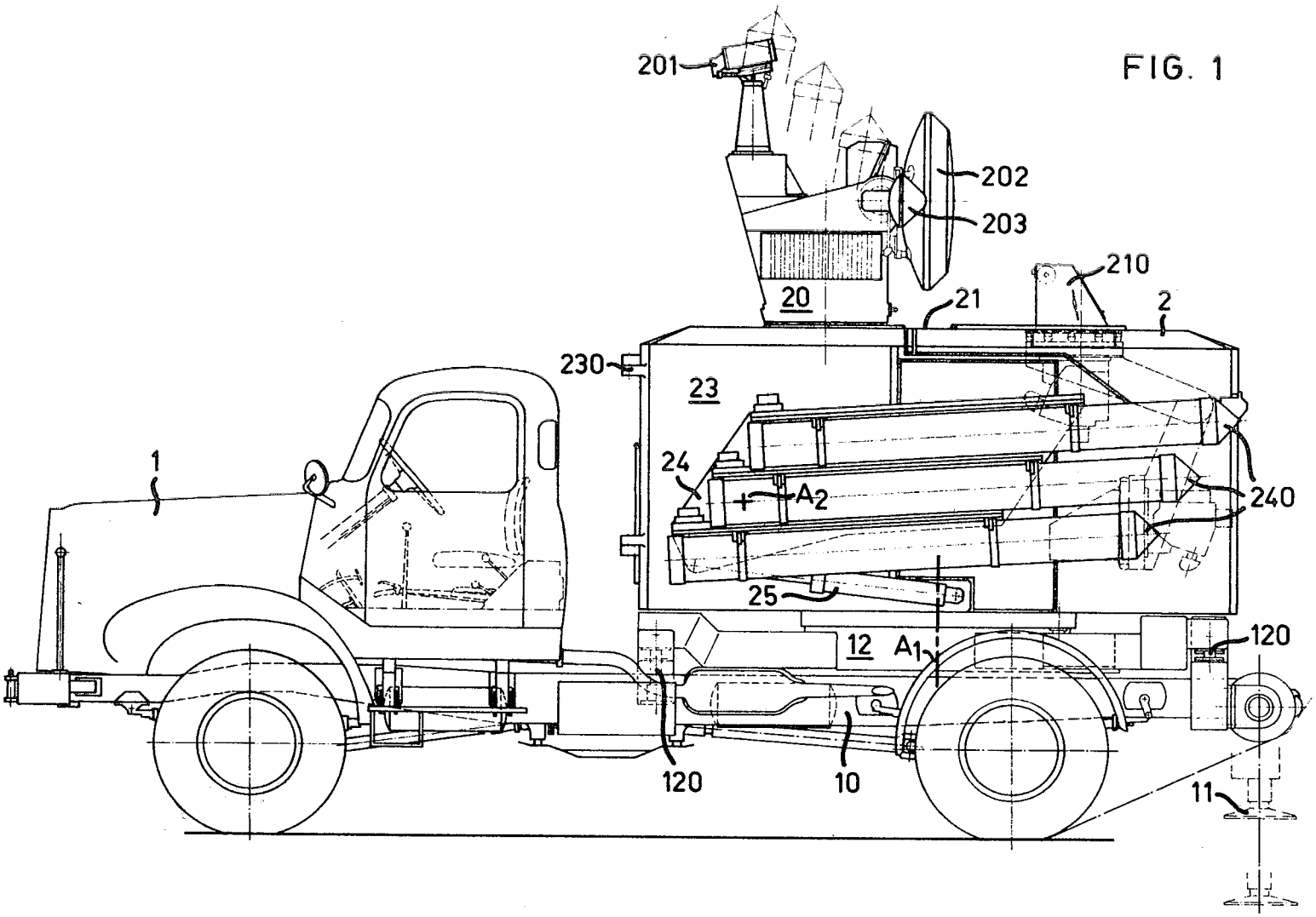
FIG. 1 is a side view of a mobile anti-aircraft device or weapon mounted upon a truck or the like and designed according to the present invention.

Describing now the drawings, in the various exemplary embodiments of the mobile anti-aircraft weapon or device disclosed herein, reference numeral 1 designates a support vehicle e.g. a truck (FIGS. 1–4) or truck-like vehicle (FIGS. 5–13) and reference numeral 10 the main chassis thereof. The embodiment shown in FIGS. 9–12 constitutes the preferred embodiment of the invention. Furthermore it is to be understood that the components of the vehicle which are not directly related to the concepts of this development have been conveniently omitted from the drawings to simplify the illustration thereof. Moreover, in all of the various embodiments herein disclosed, reference numeral 2 designates a motor driven housing which is rotatable about a substantially vertical axis $A_1$ with respect to the vehicle chassis 10. In or at each such housing 2 there is supported and mounted as a unit a respective radar tower 20 in a manner that it can be rocked or pivoted out of its travel position, which has partially been shown with broken lines, into an upright effectual or working position. At the radar tower 20 there are for instance mounted a search radar antenna 201, a tracking- and position-finding antenna 202 and a transmitter antenna 203 for transmitting control or guide command signals to a rocket or missile which is to be guided to a selected target, possibly also television cameras, laser distance measuring devices and infrared target tracking devices.

Figure 2:
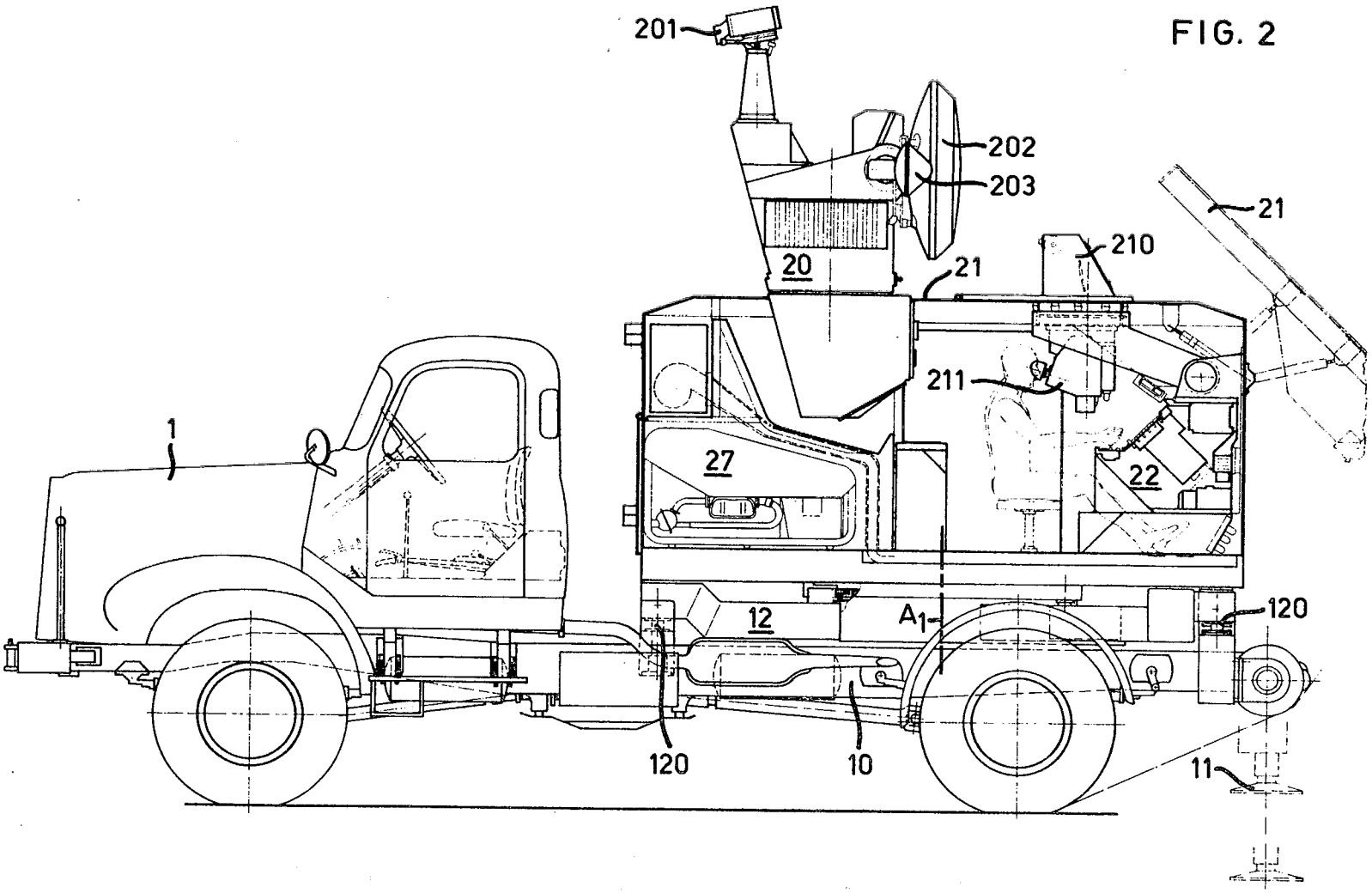
FIG. 2 is a longitudinal sectional view thereof.
Figure 3:
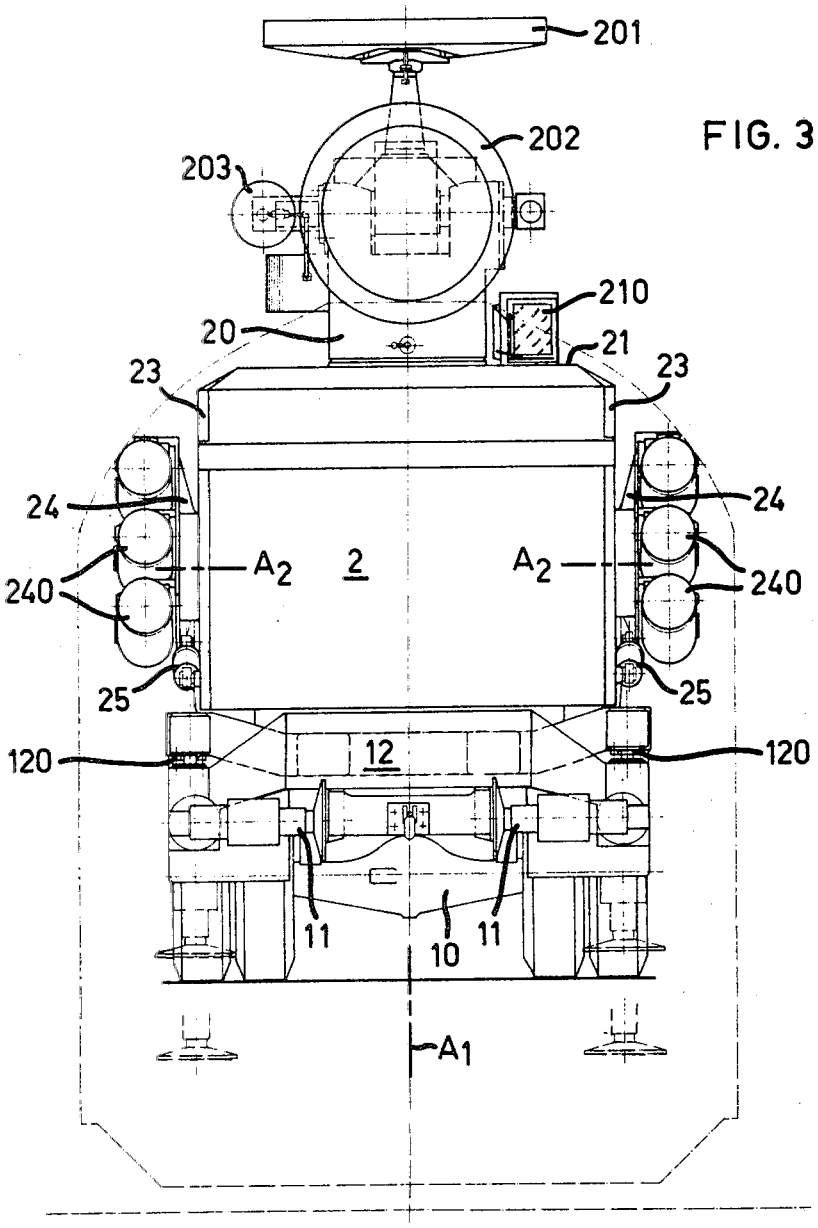
FIG. 3 is an end view thereof.
Figure 4:
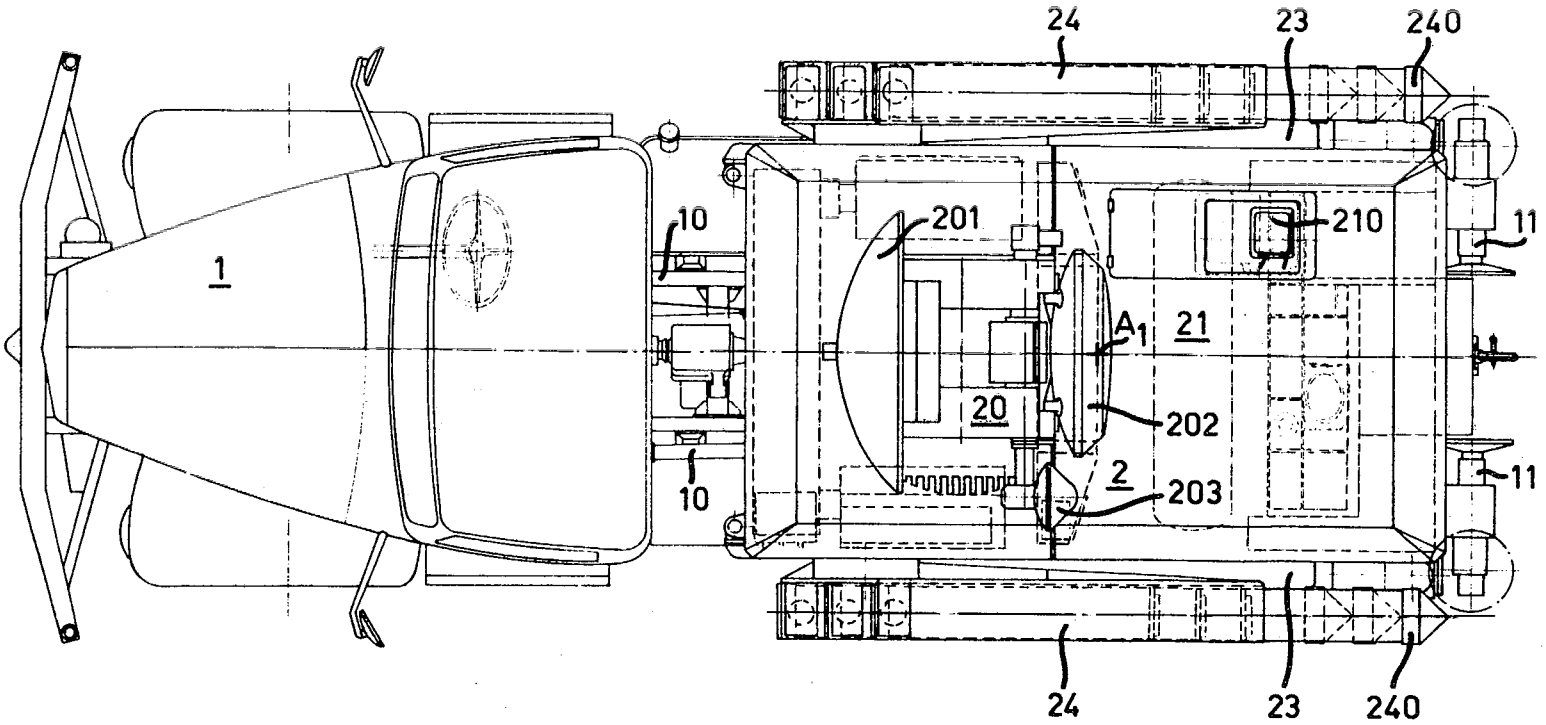
FIG. 4 is a plan view thereof.
Figure 5:
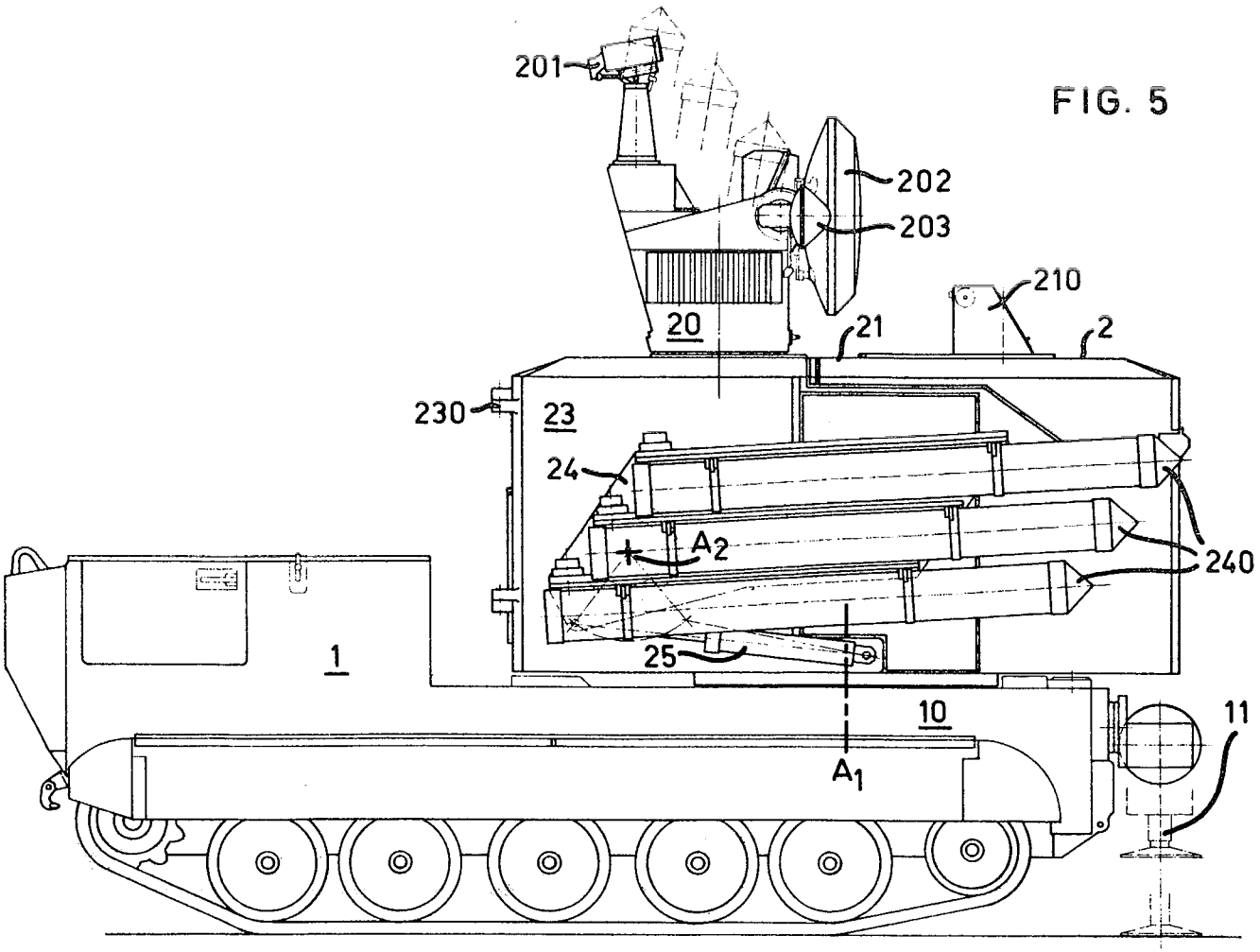
FIG. 5 is a side view of the mobile anti-aircraft device mounted upon a tracked vehicle e.g. a tank-like vehicle.
Figure 6:
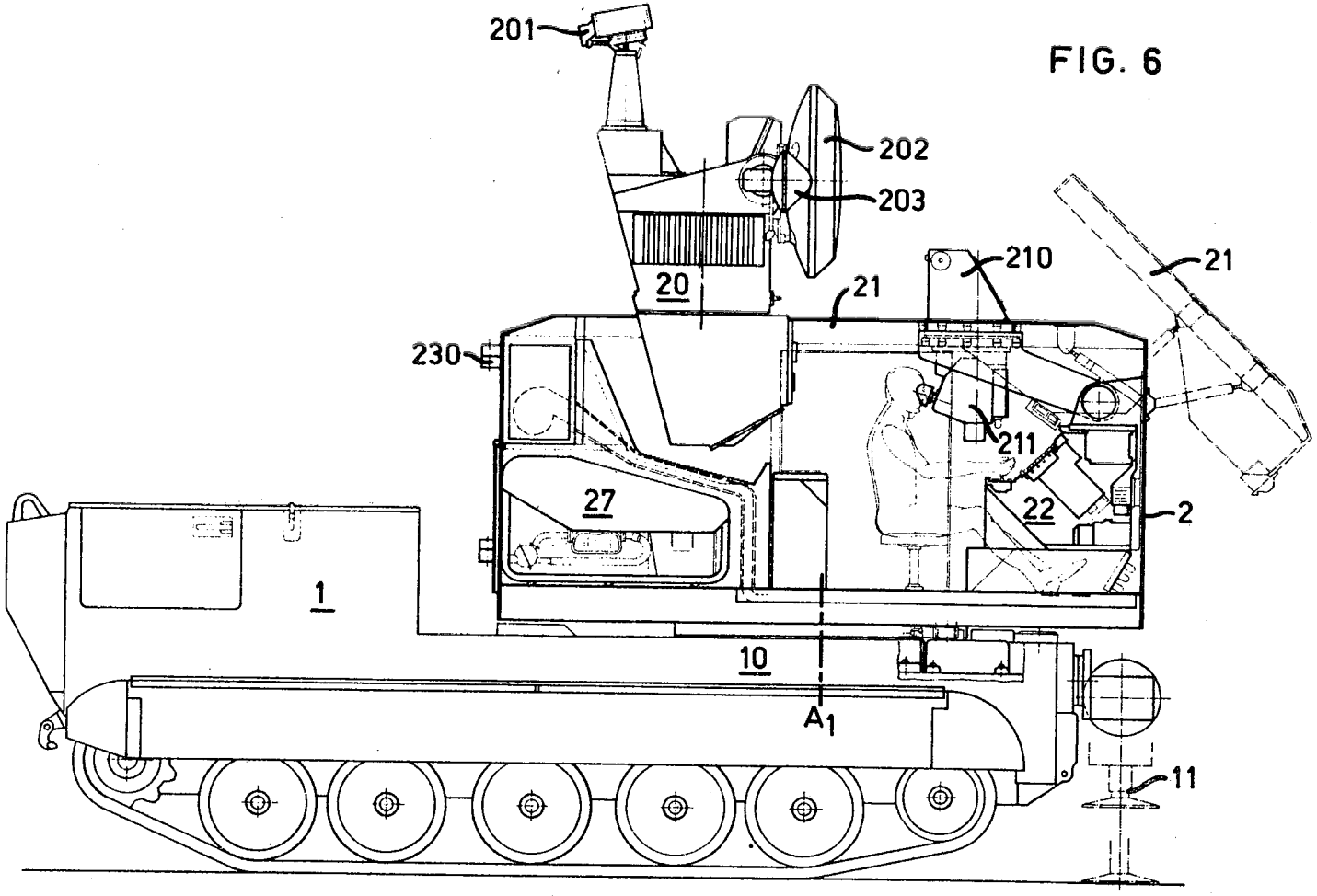
FIG. 6 is a longitudinal sectional view of the arrangement of FIG. 5.
Figure 7:
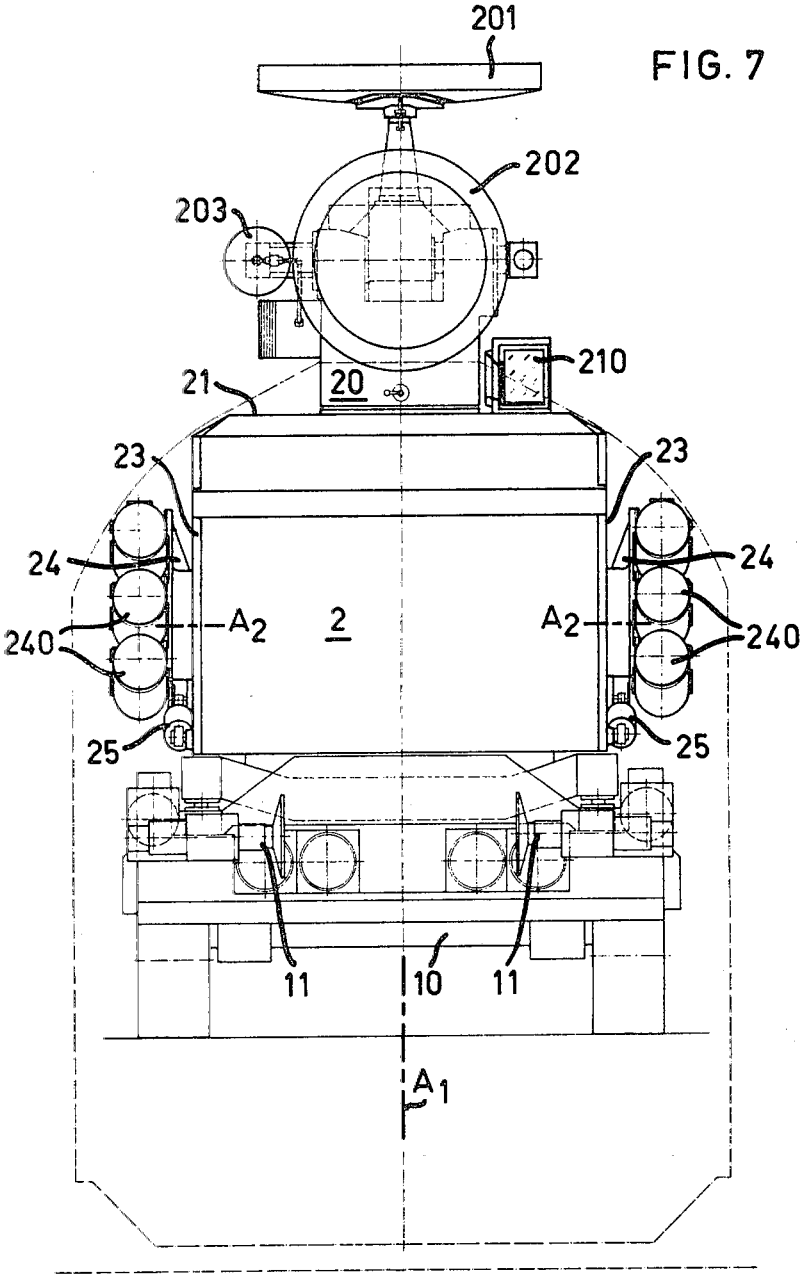
FIG. 7 is an end view of the arrangement of FIG. 5.
Figure 8:
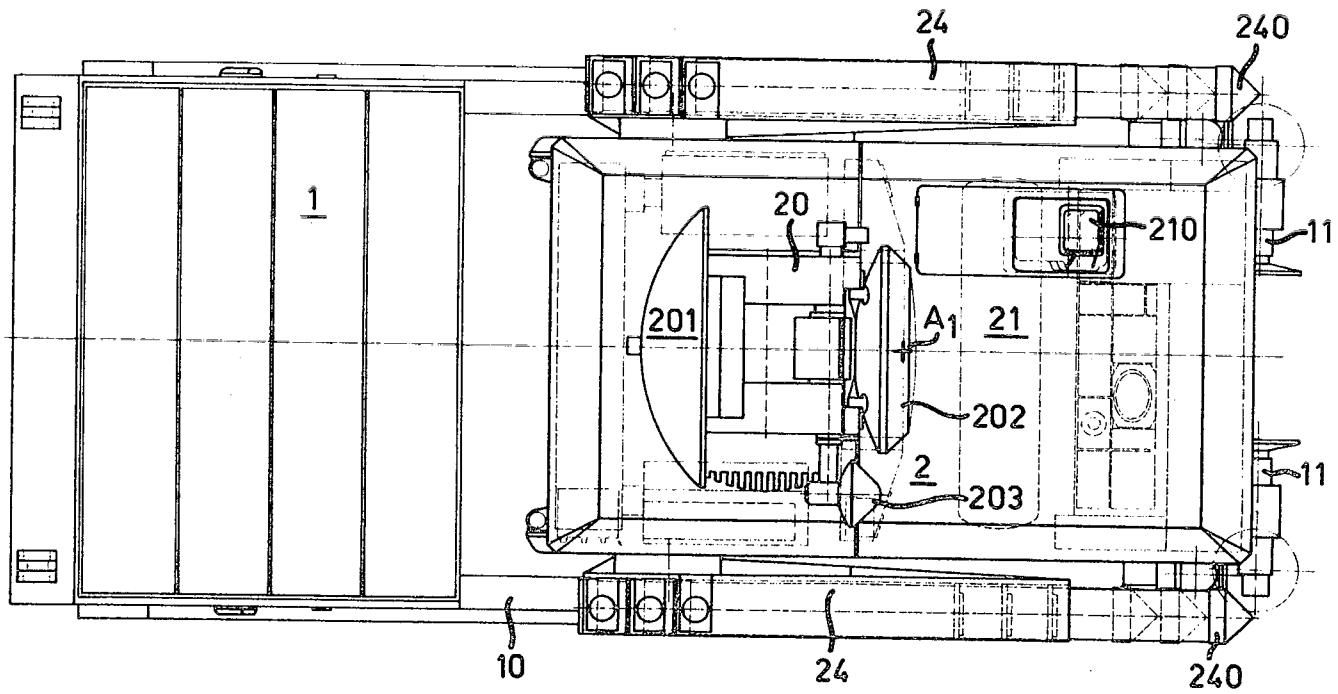
FIG. 8 is a plan view of the arrangement of FIG. 5.

At the housing cover 21, which according to the embodiments of FIGS. 2 and 6 can be pivotable, so that the radar tower 20 can be rocked into the interior of the housing 2 for travelling purposes, and according to each the embodiments depicted in FIGS. 1–13, there is mounted the outer housing 210 of a periscope, the ocular 211 of which is arranged within the housing and which can be operated by means of an operating console or control desk 22 equipped with an inclined arranged radar screen. According to the showing of FIGS. 11 and 12, the periscope housing 210 is mounted in a recess of the housing cover 21 and adjacent thereto there is located a guide command-transmitter antenna 203. At the vehicle chassis 10 of each of the herein disclosed embodiments, there are pivotably or tiltably arranged hydraulically actuatable supports 11 which can be rocked out of a horizontal travel position into a vertical operating or work position.

Figure 12:
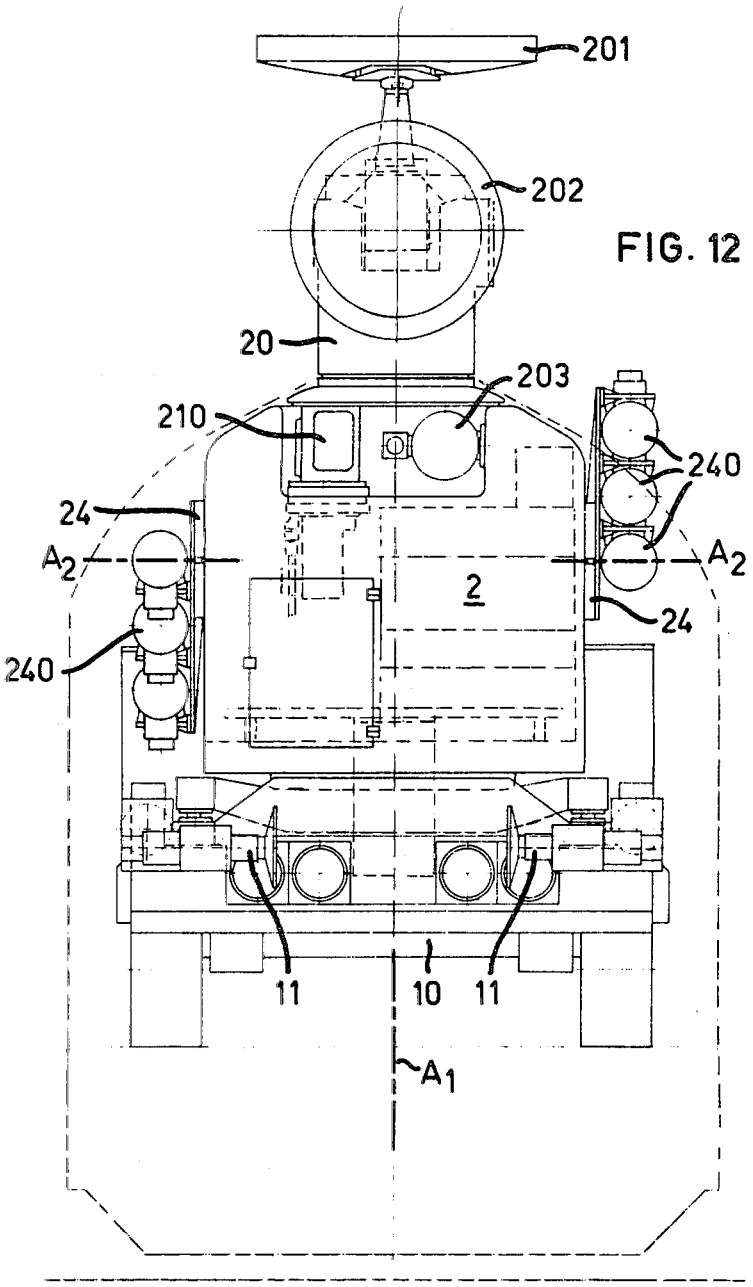
FIG. 12 is an end view of the arrangement of FIG. 9.
Figure 13:
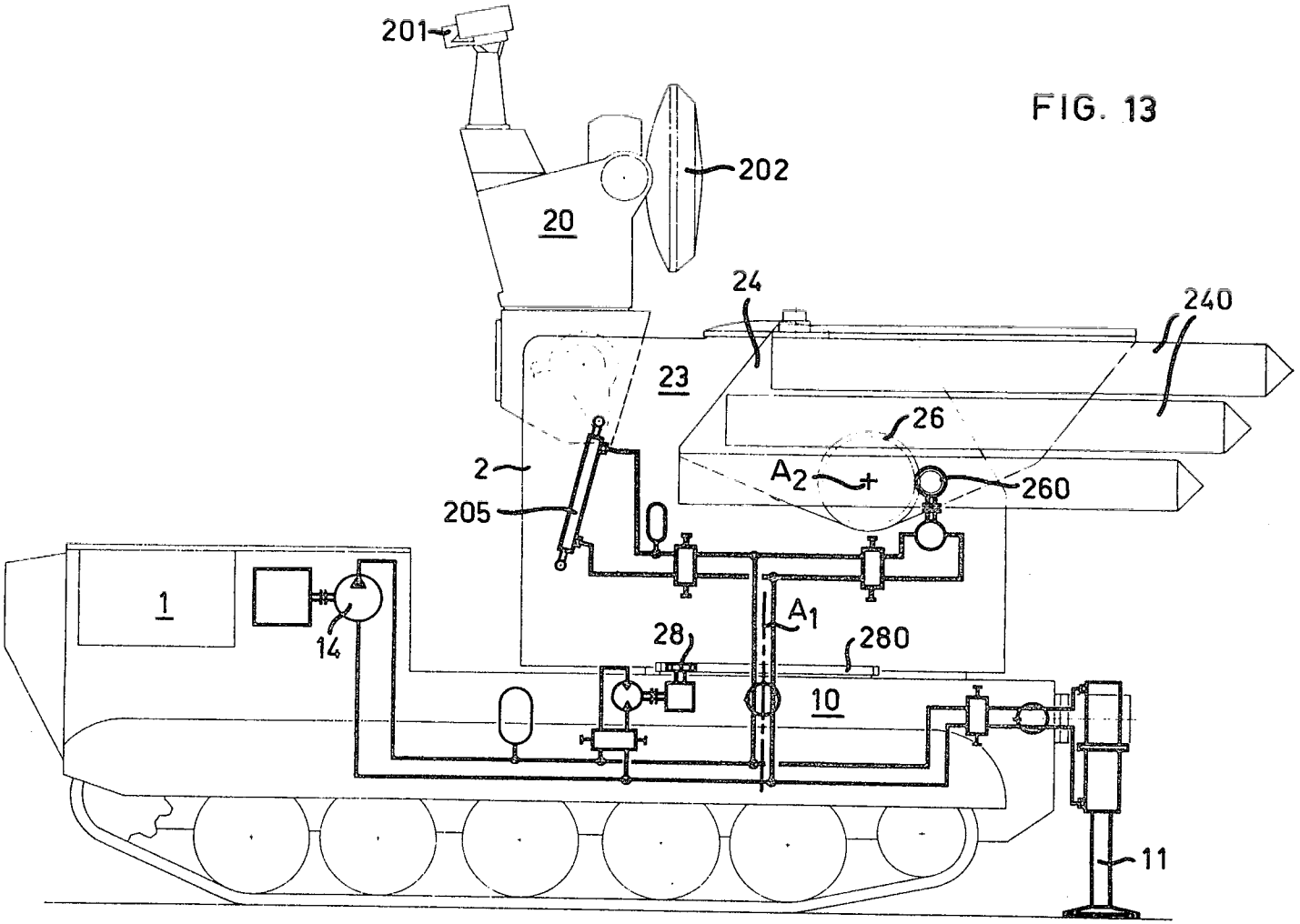
FIG. 13 is an hydraulic drive schematic of a variant construction of the exemplary embodiment of FIGS. 9–12.

According to the showing of FIGS. 1–4, a torsion-resistant intermediate chassis 12 is supported at the vehicle chassis 10 through the agency of three ball-and-socket supports or universal joints 120, this intermediate chassis containing a vertical axis-pivot bearing or support and is not subjected to the torsion of the vehicle chassis 10. At the side walls 23 of the housing 2 which are hingedly connected with such housing via the hinges 230, there are pivotably mounted for pivotal movement about the substantially horizontal axes $A_2$ suitable weapons, here shown as rocket launchers 24 for a number of rockets 240. According to the variant embodiment depicted in FIGS. 10 to 13, particularly as shown in FIG. 12, the illustrated rocket launchers 24 can be rocked out of a lower situated travel position as depicted at the left of FIG. 12, into the higher situated firing position shown at the right of FIG. 12, and in the last-mentioned position can be pivoted in elevation up to 90°. For the elevational adjustment of the rocket launchers 24 there are employed, according to the embodiments of FIGS. 1–13, for instance hydraulically actuated telescopic piston and cylinder units 25 which are hingedly connected at both ends with the weapon 24 and the housing 2 respectively. In the showing of FIG. 13, a gear 26 is pivoted at the bearing axis $A_2$ of each rocket launcher 24 via a hydraulically driven worm 260. According to the embodiments of FIGS. 2, 6 and 11 there is mounted internally of the housing 2 a current supply device 27 incorporating an internal combustion engine and a generator.

Figure 9:
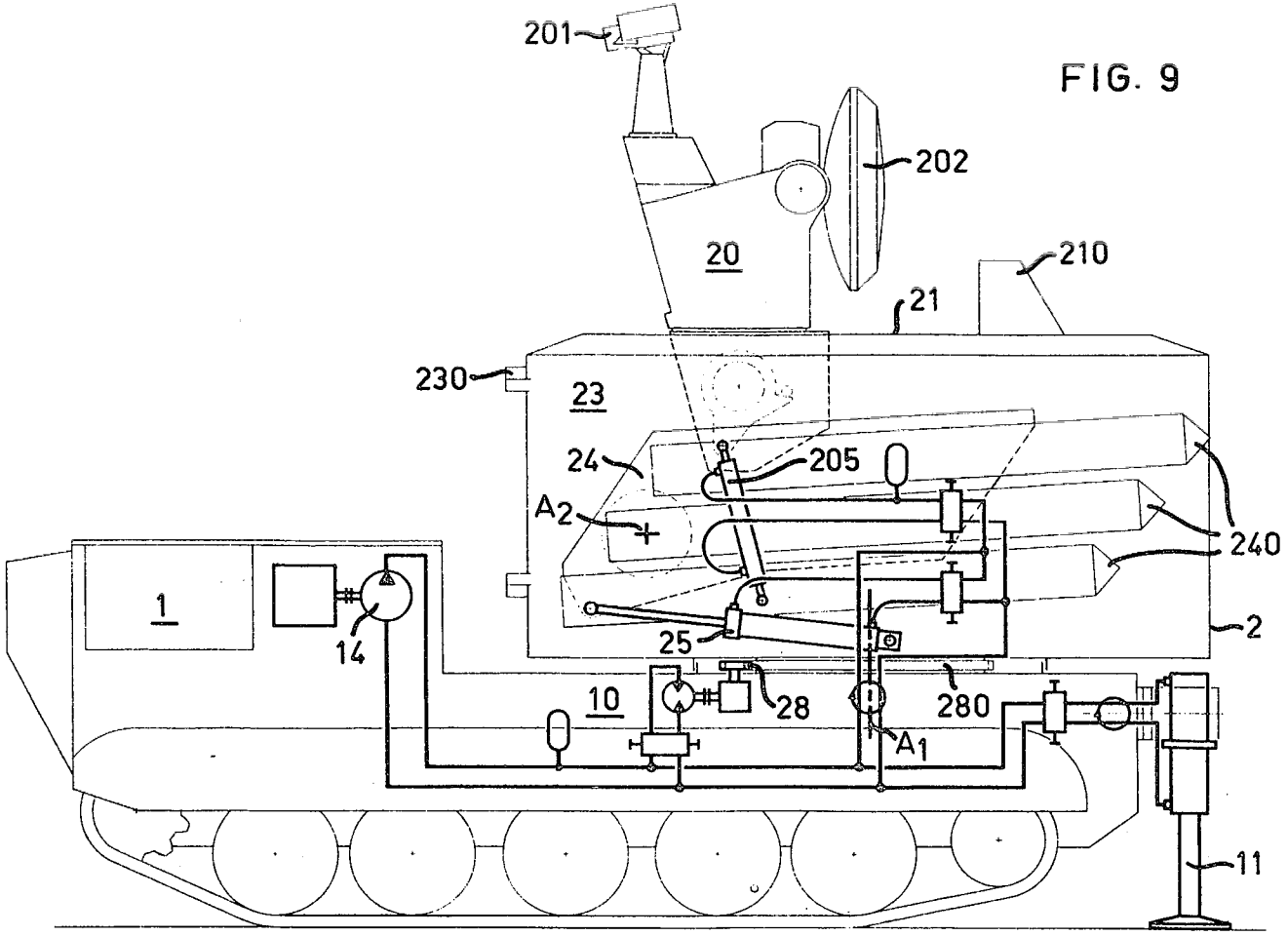
FIG. 9 is an exemplary embodiment mounted upon an armored vehicle which can travel over various terrains similar to the showing of FIGS. 5–8, and depicting details of the hydraulic drive arrangement.
Figure 10:
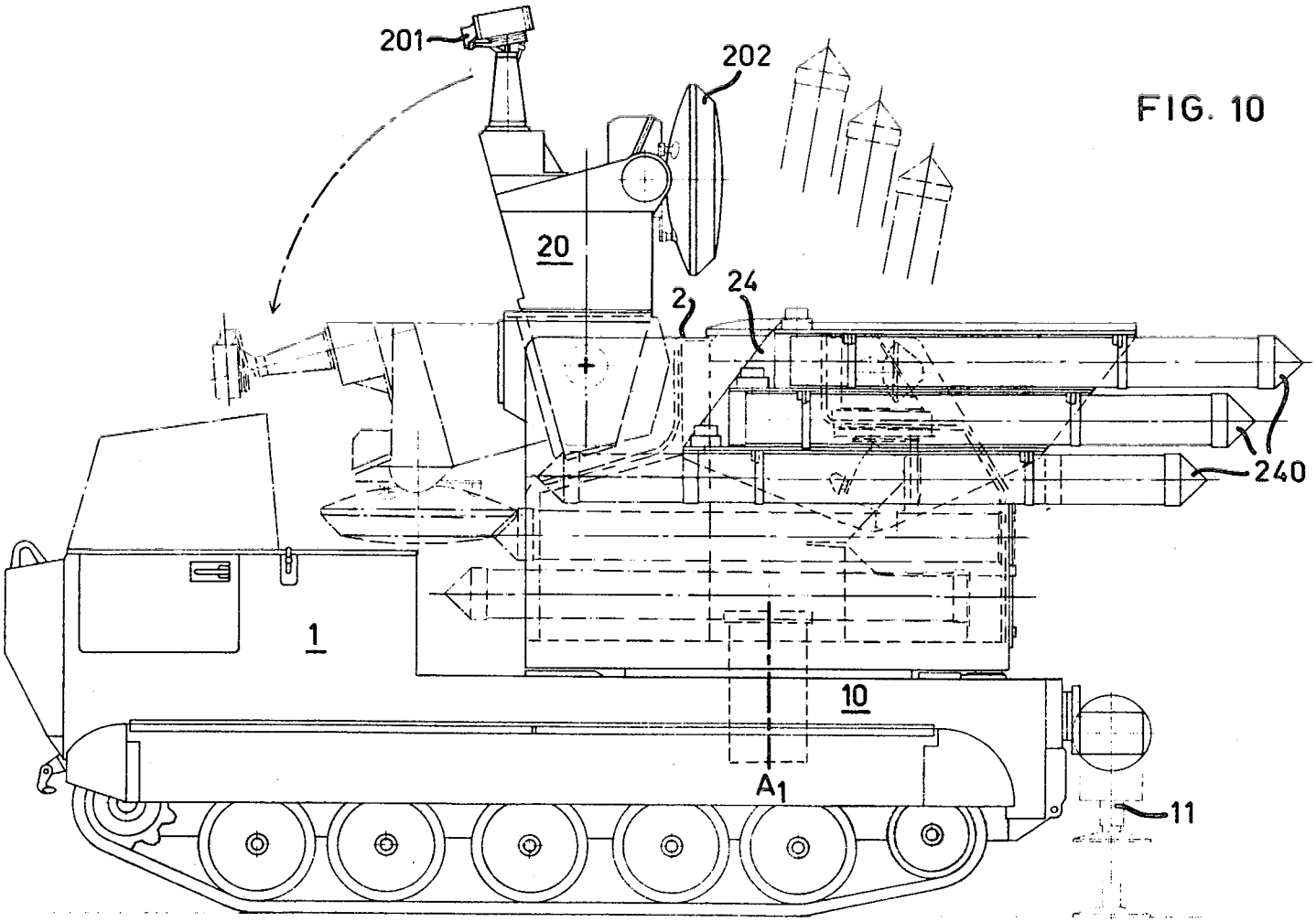
FIG. 10 is a side view of the arrangement of FIG. 9.
Figure 11:
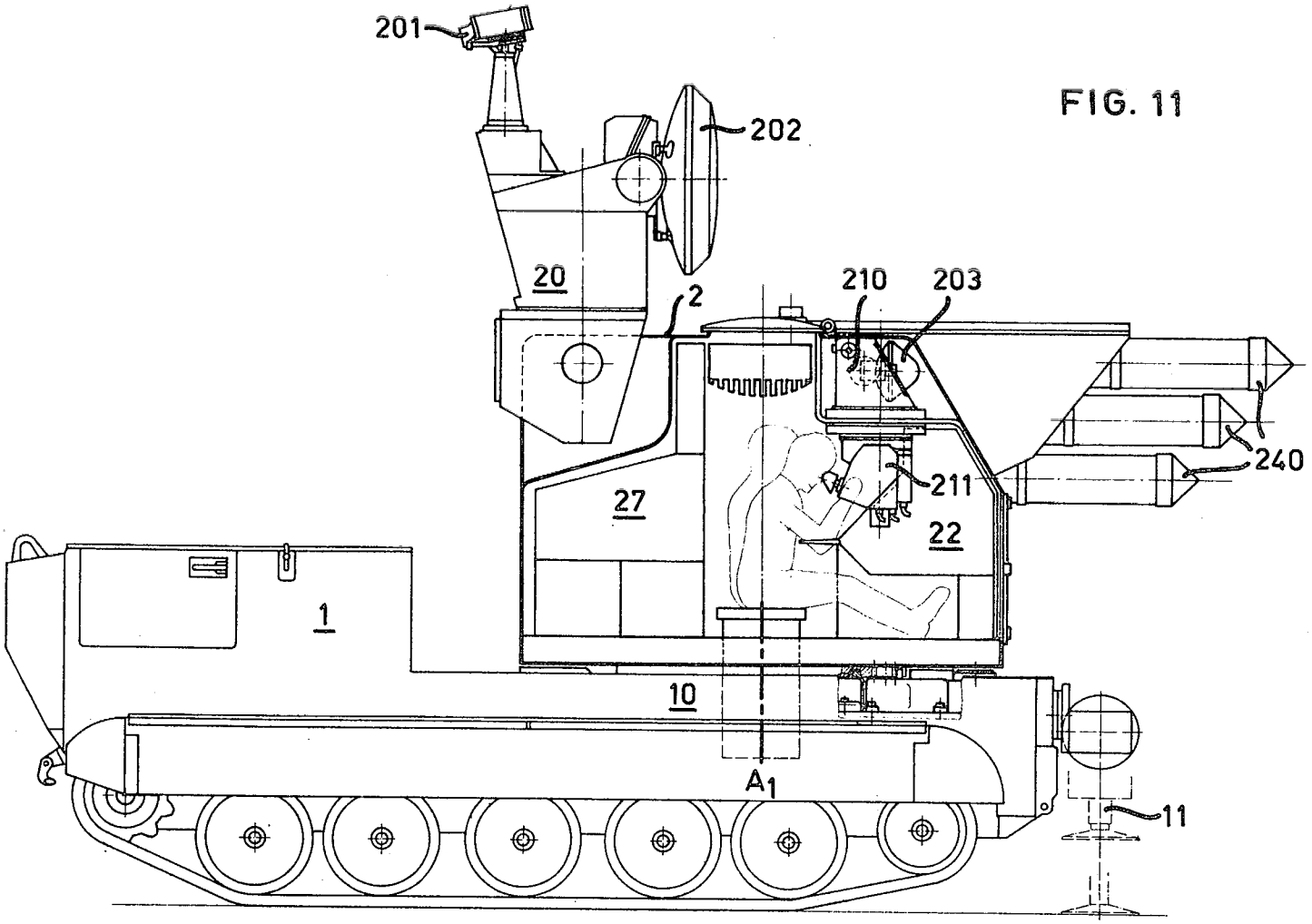
FIG. 11 is a longitudinal sectional view of the arrangement of FIG. 9.

According to the showing of FIGS. 9 and 13, by means of an hydraulic pump 14 the vehicle 1 is supplied with a pressurized fluid medium, in particular the supports 11, and adjustable piston and cylinder unit 205 for the radar tower, the adjustment devices 25 and 26 respectively for the weapons 24 and a drive worm 28 for the vertical axis-drive gear or pivot support 280 for the housing 2.

While there is shown and described present preferred embodiments of the invention, it is to be distinctly understood that the invention is not limited thereto, but may be otherwise variously embodied and practiced within the scope of the following claims.

Accordingly, what is claimed is:

1. A mobile anti-aircraft device comprising a support vehicle having a chassis, a motor driven housing rotatable about a substantially vertical axis with respect to the chassis of the support vehicle, said housing being equipped with a seat for an operating personnel as well as operating-, computing- and control devices and with observation- and target tracking devices as well as weapons, the improvement comprising said housing being provided with substantially flat pivotable side doors, hinge means for mounting said doors to be pivotable outwardly about a substantially vertical axis, and rocket launcher means for a number of rockets serving as weapons externally mounted at said side doors.

2. The mobile anti-aircraft device as defined in claim 1, further including hydraulically actuated piston-cylinder means for pivoting the rocket launchers about substantially horizontal bearing axes, the cylinders of said piston-cylinder means being pivotably supported at the associated side door.

3. The mobile anti-aircraft device as defined in claim 2, further including hydraulically actuatable supports which can be adjusted out of a travel position into a work position and adjustably arranged at the vehicle chassis.

4. The mobile anti-aircraft device as defined in claim 3, further including a torsion-resistant intermediate chassis, said housing which is rotatable about a substantially vertical axis being provided with substantially vertical axis-pivot bearing means, said vertical axis-pivot bearing means being arranged at said torsion-resistant intermediate chassis, and a plurality of pivot supports for supporting the torsion-resistant intermediate chassis at the vehicle chassis.

5. A mobile anti-aircraft device comprising a support vehicle having a chassis, a motor driven housing rotatable about a substantially vertical axis with respect to the chassis of the support vehicle, said housing being provided with side doors, hinge means for mounting said doors to be pivotable outwardly, and rocket launcher means for a number of rockets serving as weapons externally mounted at said side doors.

* * * * *